United States Patent [19]

Gorski

[11] Patent Number: 4,498,028

[45] Date of Patent: Feb. 5, 1985

[54] ULTRA-SHORT LOBI ELECTRON GUN FOR VERY SHORT CATHODE RAY TUBES

[75] Inventor: Richard M. Gorski, Chicago, Ill.

[73] Assignee: Zenith Electronics Corporation, Glenview, Ill.

[21] Appl. No.: 306,449

[22] Filed: Sep. 28, 1981

[51] Int. Cl.[3] ..... H01J 29/46; H01J 29/56

[52] U.S. Cl. ..... 315/15; 313/449

[58] Field of Search ..... 315/14, 15, 382; 313/447, 448, 449

[56] References Cited

U.S. PATENT DOCUMENTS

| | | | |
|---|---|---|---|
| 4,178,532 | 12/1979 | Fukuzawa et al. | 315/15 |
| 4,287,450 | 9/1981 | Kawakami et al. | 315/14 |
| 4,318,027 | 9/1979 | Hughes et al. | 315/15 |
| 4,383,199 | 5/1983 | Washino et al. | 315/15 |

FOREIGN PATENT DOCUMENTS 2020092A 11/1979 United Kingdom .

OTHER PUBLICATIONS

Theoretical and Practical Aspects of Electron Gun Design for Color Picture Tubes, IEE Transactions on Consumer Electronics, vol. CE-21, No. 1, Feb. 1975, by I. M. Wilson.

A Novel High-Voltage Bipotential CRT Gun Design, by Hughes and H. Y. Chen, 0098-3063/79/0400-0185, IEEE 0098-3063/79/0400.

*Primary Examiner*—Theodore M. Blum

*Attorney, Agent, or Firm*—Cornelius J. O'Connor

[57] ABSTRACT

An ultra-short high-performance LoBi electron gun is disclosed for use in very short cathode ray tubes. The gun comprises lower end means having a cathode for developing an electron beam, at least one apertured plate grid electrode for forming the beam in conjunction with the cathode, and at least one apertured plate prefocusing electrode for developing a crossover in the beam in conjunction with the grid electrode. The gun also comprises a main focus lens means for receiving, focusing and accelerating the beam. The lens means includes cylindrical focusing electrode means for focusing a beam spot of minimum size on the screen. The spacing between the focusing electrode and the prefocusing electrode, and the relative difference in potential therebetween, is effective to develop a weak electrostatic field for forming a steeply expanding beam, while cylindrical accelerating electrode means provides for accelerating the beam. The ratio of the potentials on the accelerating electrode and the focusing electrode is greater than six to one for forming a relatively strong electrostatic field therebetween. The weak electrostatic field between the prefocusing electrode and the focusing electrode means is effective to produce the steeply expanding beam for optimum filling of the main focus lens means. The relatively strong electrostatic field between the focusing electrode means and the accelerating electrode means is effective to produce a finely focused electron beam notwithstanding the ultra-short length of the gun.

1 Claim, 6 Drawing Figures

ULTRA-SHORT LOBI ELECTRON GUN FOR VERY SHORT CATHODE RAY TUBES

BACKGROUND OF THE INVENTION AND PRIOR ART DISCLOSURE STATEMENT

This invention relates generally to cathode ray picture tubes, and is specifically addressed to an electron gun for use in very small picture tubes intended primarily for dashboard installation in vehicles. The invention also has utility in other very small cathode ray picture tube applications.

An electron gun for use in a cathode ray tube intended for a vehicle (a "VCRT"), must meet severe operational and physical constraints. These constraints are best pointed up by comparison of the VCRT with the standard cathode ray tube of five-inch diagonal measure intended for a small consumer product television receiver.

Peak brightness of the VCRT, for example, is preferably of the order of ten times the brightness (under typical operating conditions) of a cathode ray tube used in a consumer product television receiver. This magnitude of brightness is mandatory in compensating for the brightness loss caused by the neutral density filtering normally used to increase contrast. The electron gun beam current and beam energy is not the sole factor in providing the necessary brightness; special, high-performance phosphors are also required.

Because of space constraints, especially in behind-the-dashboard installations, the VCRT, as a practical matter, must be ultra-short; that is, preferably less than five inches in depth (or length), and must have a very wide deflection angle, preferably greater than 110 degrees. In contrast, the standard CRT with a five-inch face panel is normally about eight inches in length, and the deflection angle is commonly a relatively narrow 70 degrees.

The length of the electron gun must be greatly reduced if the objective of a very short VCRT is to be fulfilled. The reducing of gun length presents major problems to the gun designer that resulted in the inventive solution set forth herein.

Quick comprehension of a displayed message for quick decision making is a firm requirement in VCRT's, so the resolution of the tube must be high. The degree of resolution is largely a function of beam spot size in monochrome cathode ray tubes. The spot size of a VCRT of less than five inch length is preferably no greater than about 40 mils at 2,000 foot-Lamberts, for example, while the spot size of the standard five-inch CRT cited for comparison provides satisfactory performance with a spot size of about 80 mils at the same brightness.

With regard to power consumption, the large deflection angles and higher beam currents results in a higher power consumption—of the order of three times that required by the standard five-inch CRT.

In a journal article titled "Theoretical and Practical Aspects of Electron Gun Design for Color Picture Tubes," Dr. I. M. Wilson provides some insight into the theoretical and practical constraints imposed on the designer of electron guns for color picture tubes. (IEEE Transactions on Consumer Electronics, Volume CE-21, No. 1, February 1975.) The analytical method described takes into account the three principal effects that determine the size of the focused beam on the screen—magnified cross-over, spherical aberration of the lens, and space charge in the drift space. The calculated and measured data for a gun using this design method is presented. The relevance of this disclosure to the present invention is set forth infra.

A high-voltage bipotential gun is described in a journal article by R. H. Hughes and H. Y. Chen of the RCA picture tube division. It is alleged that its performance is significantly improved over the conventional bipotential gun and is approximately equivalent to the tripotential gun. The relevance of this disclosure to the present invention is also set forth infra. (Hughes, Chen: "A Novel High-Voltage Bipotential CRT Gun Design," 0098-3063/79/0400-0185, IEEE.)

In UK Patent Application GB No. 2 020 092 A (RCA), there is disclosed a high potential, low magnification electron gun for use in color picture tubes. This bipotential-type gun comprises a cathode, an apertured plate control grid (G1), an apertured plate screen grid (G2), and at least two tubular focusing electrodes (G3 and G4). It is stated that the quality of the gun's beam spot may be improved by (1) establishing an operating electric field between the G2 and G3 which is between about 100 and 400 volts/mil thereby reducing aberration effects in the beam-forming region of the gun; (2) making G2 thick so as to prevent the high G3 voltage from penetrating the region between G1 and G2, thereby allowing the G1–G2 field to provide a divergent effect on the electron beam prior to beam crossover and thus give a reduced crossover angle; (3) elongating G3 to provide an optimum filling of the main focus lens with a beam to maximize the object distance of the focusing system; and (4) structuring G2 and G3 to provide a flat electrostatic field therebetween to avoid prefocusing action in that region so as not to cause an effective reduction of the object distance of the focusing system. The focusing electrode (G3) potential is specified as being 8.5 kV and the accelerating anode (G4) potential is 30 kV; this gun merits the appellation "HiBi" because of the relatively high focusing voltage. ("HiBi" is an abbreviated acronym for "high focus voltage bipotential (gun).")

OBJECTS OF THE INVENTION

It is a general object of this invention to provide an improved electron gun for use in vehicular cathode ray tubes.

It is a less general object of this invention to provide an electron gun for vehicular cathode ray tubes that contributes to a very high display graphics brightness permitting the use of a darkly tinted face panel.

It is a more specific object of the invention to provide an electron gun for a vehicular cathode ray tube having a spot size sufficiently small to provide maximum display graphics legibility.

It is a specific object of this invention to provide an electron gun for a vehicular cathode ray tube having an ultra-short length contributive to a cathode ray tube of very short length.

It is another specific object of the invention to provide a gun for a vehicular cathode ray tube having an ultra-short gun-to-screen distance.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, in which:

(Note: FIGS. 4, 5 and 6 are depicted approximately two times relative to normal size.)

DESCRIPTION OF THE PREFERRED EMBODIMENT

Figure 1:
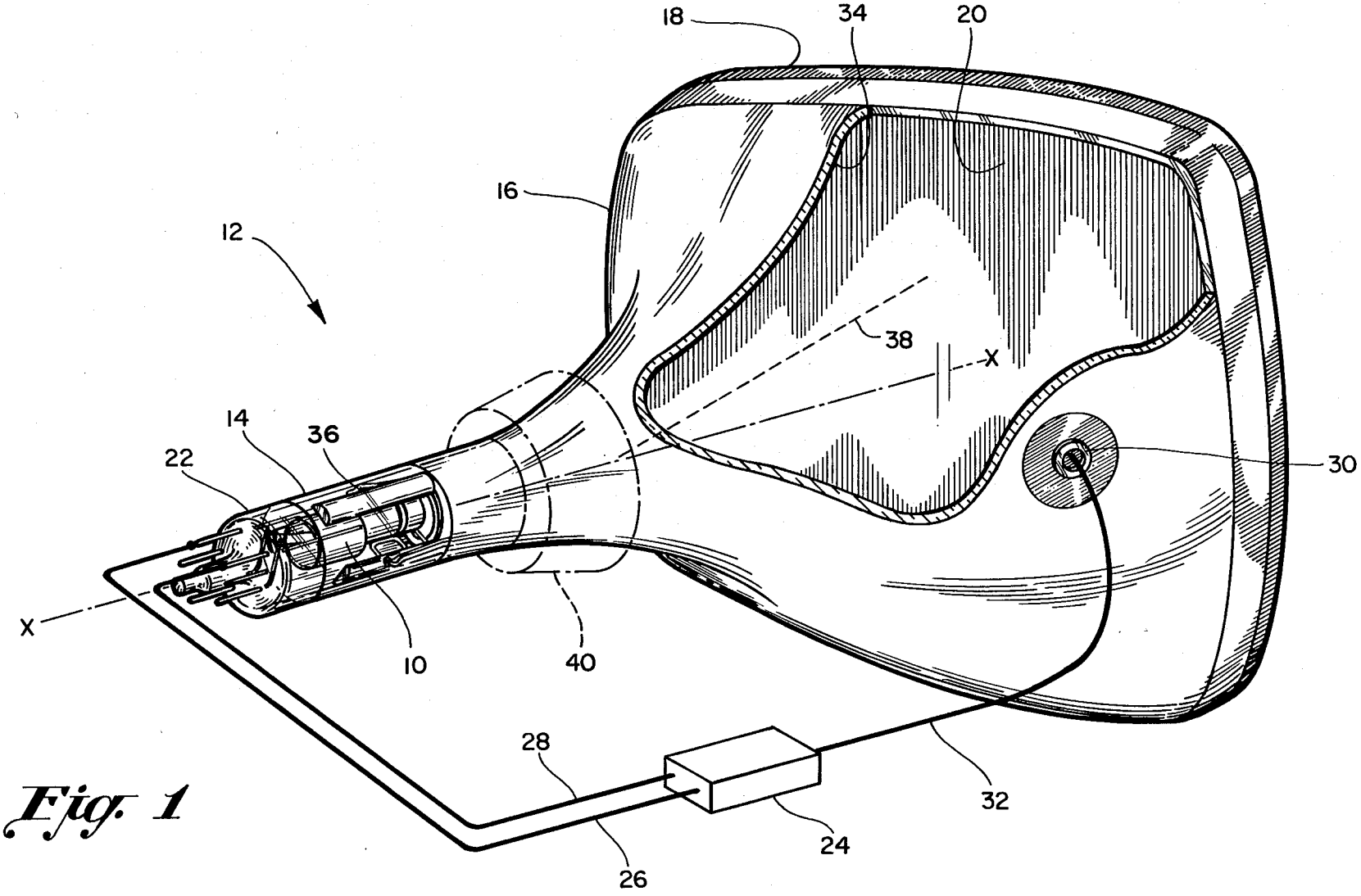
FIG. 1 is a view in perspective of an ultra-short electron gun according to the invention as installed in a very short cathode ray tube depicted as being partly cut away.

An ultra-short, high-performance LoBi electron gun 10 according to the invention is shown in FIG. 1 as installed in a very short cathode ray tube 12. The tube 12 depicted is of the type designed for dashboard installation in vehicles, and has, by way of example, an overall depth (or length) of five inches, or less, and a deflection angle approximately 112 degrees.

The relationship of the ultra-short LoBi electron gun 10 according to the invention with the picture tube 12 is indicated by FIG. 1. The primary components of picture tube 12 comprise an evacuated glass envelope including a neck 14, a funnel 16, and a face panel 18. On the inner surface of face panel 18 there is indicated an imaging screen 20 consisting of a uniform layer of cathodoluminescent material normally comprising a phosphorescent material which, upon excitation by the impact of a scanning beam of electrons, emits visible light. The light emitted may be white, or it may be of the monochrome type that emits a colored light such as red, green or blue. Base 22 provides for entrance of supply voltages for gun 10.

The ultra-short, LoBi electron gun 10 according to the invention is indicated as being located within neck 14 substantially as shown. Gun 10 is normally installed in alignment with axis X—X of tube 12.

Power supply 24, also indicated schematically, is associated with cathode ray tube 12 for developing a predetermined pattern of supply voltages for gun 10 and tube 12. A special voltage divider circuit is typically incorporated into the power supply to provide a range of potentials required for tube and gun operation. For example, power supply 24 supplies a relatively low voltage of about 310 volts through an electrical conductor 26 depicted as being connected to one of the pins indicated as extending from base 22. Power supply 24 also provides a relatively intermediate voltage of approximately 1,700 volts through another conductor 28 indicated as being connected to another pin extending from tube base 22.

Power supply 24 also provides a relatively high voltage of about 12,000 volts to anode button 30 through a conductor 32. Anode button 30 in turn introduces the relatively high voltage through the funnel 16 to make internal contact with thin, electrically conductive coating 34 disposed on the inner surface of funnel 16, and extending part way into neck 14. An accelerating electrode of gun 10 receives the relatively high voltage through a plurality of gun centering springs 36 extending from gun 10, and in physical contact with inner conductive coating 34.

Gun 10 is depicted as emitting a single electron beam 38 for scanning the cathodoluminescent screen 20. Scanning of the beam is accomplished by means of a deflection yoke 40, shown schematically as encircling neck 14 and extending part way onto funnel 16.

Figure 2:
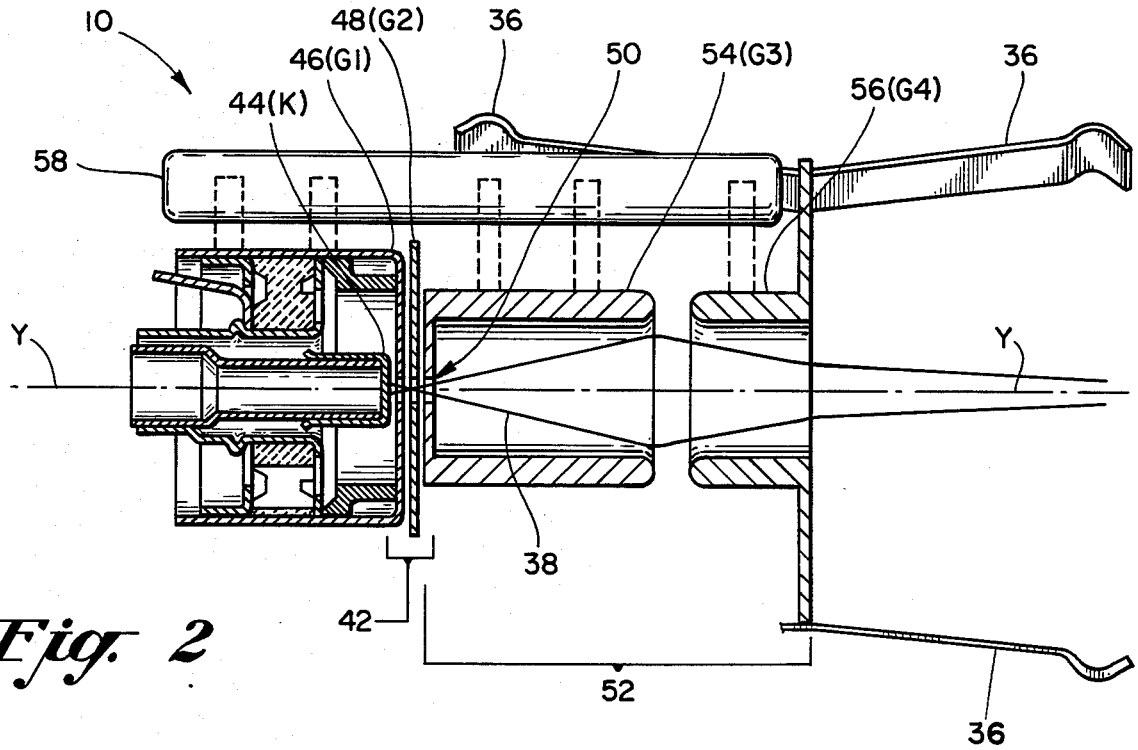
FIG. 2 is a longitudinal elevation in section showing details of an ultra-short, LoBi electron gun according to the invention.

FIG. 2 is a detail view of a preferred embodiment of the ultra-short, LoBi electron gun 10 according to the invention. Gun 10 is depicted as having a series of apertured electrodes aligned in spaced relation on an axis Y—Y for receiving the aforedescribed predetermined voltages described from power supply 24 to produce a finely focused beam of electrons on screen 20. Gun axis Y—Y is substantially congruent with the axis X—X of tube 12. The ultra-short LoBi electron gun according to a preferred embodiment of the invention comprises the following components in the order named.

Lower end means 42, indicated by the bracket, has a cathode 44(K) for developing the electron beam 38. Lower end means 42 further includes at least one (shown as being one) apertured plate grid electrode 46 (G1) for forming, in conjunction with the cathode 44, electron beam 38. Also included in lower end means 42 is at least one apertured plate prefocusing electrode 48 (G2), also indicated as being one electrode. An apertured plate electrode consists of a plate such as a disk or a rectangle having an aperture therethrough; this is in contradistinction to the "cylinder" electrode which is tubular.

Prefocusing electrode 48 receives the aforedescribed relatively low prefocusing voltage of about 310 volts from power supply 24 for developing, in conjunction with grid electrode 46, a crossover 50 in beam 38, the general location of which is indicated by the arrow.

Main focus lens means 52, indicated by the bracket, provides for receiving, focusing and accelerating beam 38. Main focus lens 52 includes cylindrical focusing electrode means 54 (G3) for receiving the relatively intermediate beam focusing voltage of approximately 1,700 volts from power supply 24 for focusing a beam spot of minimum size on screen 20. Focusing electrode 54 has a lens diameter to length ratio of about 0.5.

Beam "spot size" is defined as the diameter from edge to edge of the beam expressed in mils at a landing point on screen 20. The "edge" of a beam is defined as those points near the circumference of the beam where the current density due to fall-off is only five percent of the peak current density at the center of the beam. The ultra-short LoBi electron gun according to the invention projects a beam spot having a diameter of approximately 40 mils on screen 20 at a "throw" distance of about 3.3 inches; that is, the distance between the screen end of the accelerating electrode and the center of screen 20. This approximately 40-mil spot size is noted as being produced at a beam current of about 1.5 milliamperes. At a lower beam current, 0.2 milliamperes, for example, the spot size is about 17 mils.

The spacing between focusing electrode 54 and prefocusing electrode 48 is approximately 0.010 inch. This spacing, and the relative difference in potential of the two electrodes 48 and 54 (in addition to other factors as will be described), is effective to develop a weak electrostatic field therebetween for establishing a steeply expanding beam having an entry angle exceeding 100 milliradians and in the range of 126–150 milliradians, and preferably about 135 milliradians. The weak electrostatic field is noted as having a field strength of about 54 volts/mil, and a G2 potential to G3 potential ratio of about 0.18. Field strength is considered for the purposes of this disclosure as being that strength as measured on the gun axis Y—Y midway between the two electrodes.

Main focus lens means 52 also includes a cylindrical accelerating electrode means 56 (G4) for receiving the relatively high beam accelerating voltage of approximately 12,000 volts from power supply 24 for accelerating beam 38. The ratio of the potentials of the voltage on the accelerating electrode and the voltage on the focusing electrode is greater than six to one for forming a relatively strong electrostatic field therebetween. This relatively strong electrostatic field has a field strength of approximately 330 volts/mil.

The weak electrostatic field between prefocusing electrode 48 and focusing electrode 54 is effective to produce the steeply expanding beam described. It is noted that beam 38 optimally fills main focus lens means 52, as indicated. The relatively strong electrostatic field between the focusing electrode 54 and accelerating electrode 56 is effective to produce a finely focused electron beam 38 notwithstanding the ultra-short length of gun 10.

Oppositely facing gun centering springs 36, one pair of which is shown, extend from accelerating electrode 56 to make contact with the inner conductive coating 34. The cathode assembly and the electrodes G1–G4 are indicated as being fixed in proper relationship and alignment by a multiform glass bead 58. Only one such bead is indicated; there are normally two or more.

A novel characteristic of the ultra-short Lo-Bi electron gun according to the invention lies in the relatively large beam entry angle; that is, an entry angle noted as being in the range of 126–150 milliradians, and preferably about 135 milliradians.

An electron beam diverging from the cross-over of electron gun defines a "half angle" with respect to the axis of the gun. The half angle is essentially a measure of beam growth in diameter as the beam diverges from the cross-over. The half angle is variously termed a "semi-angle" or a "divergence angle". In this disclosure, it is designated by the more descriptive term "entry angle" as it denotes the angle of the beam envelope upon its entry into the main focus lens.

Figure 3:
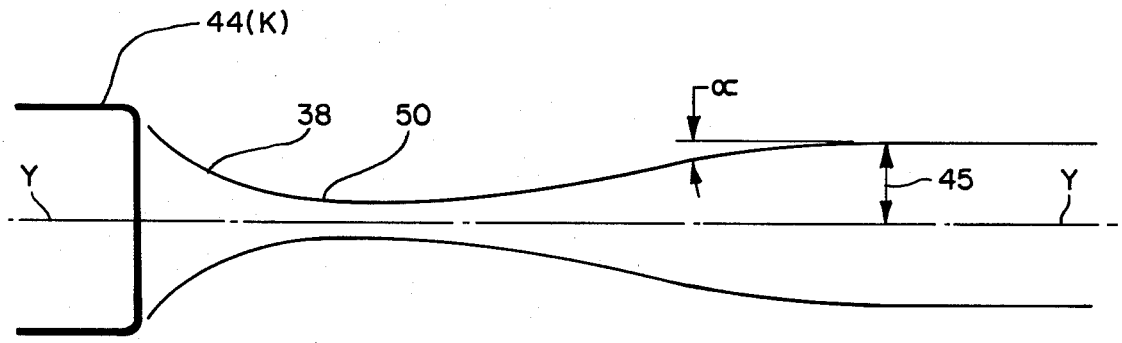
FIG. 3 is a diagram in profile of an electron beam indicating an entry angle defined with respect to the axis of the beam.

An entry angle and means for its measure are shown schematically by FIG. 3. The cathode 44 (K) is indicated as emitting a stream of electrons which is formed into the beam 38. A cross-over 50 is formed from which beam 38 diverges. The slope of expansion of beam 38 defines an angle $\alpha$ with respect to the axis Y—Y of the electron gun. Angle $\alpha$ is measured from a selected "cut line" 45, which is, essentially, a region where the equipotential lines are perpendicular to the gun axis everywhere from the axis to the edge of the field.

The slope of an entry angle depends in a measure on the electro-mechanical design parameters of the lower end section of the electron gun. The factors that affect formation on the crossover and subsequent prefocusing of the beam prior to its entry into the main focus lens, and the resultant entry angle, include the configuration of the first and second grids; spacing between the cathode and the first grid, between the first and second grids, the second grid and the following element of the main focus lens; aperture sizes, and the configurations of the grids as designed to establish the prefocusing fields. The primary influences, however, on the degree of slope is the field between the second and third grids is established by the difference in potential of the grids, the spacing between the grids, and the diameters of the grid apertures.

In prior art guns, beam entry angles are preferably in the 45–60 milliradian range, and gun designers have striven to provide the smallest possible beam entry angle. This statement finds substantiation in the following quotation from the journal article by Hughes and Chen (Op.cit.).

> "The optimization condition can be shown on the plotted curve in FIG. 2. From these curves it is clear that if it is the intention to reduce the optimized electron spot, new lower $D_m$ and $D_{sa}$ curves* must be obtained and most important of all, *the new gun must be operated with a reduced beam angle.*" (Emphasis added.)

(*Note: $D_m$ and $D_{sa}$ are, respectively, the Gaussian beam spot distribution due to the magnification of the system, and the spherical aberration of the system.)

Further substantiation as to the desirability of relatively small beam entry angles in prior art gun design is provided in the journal article by Wilson (Op.cit.). Here is what Wilson has to say about beam entry angles and their relevance to optimum gun performance—

> " . . . the most important parameter in gun design is the emerging angle $\alpha$."

and—

> " . . . the optimum angle does not vary significantly with changes in W (or crossover size). What this in turn says is, that after we have optimized the gun for $\alpha$, the spot size might not be exactly equal to the calculated value, but we can be reasonably sure that the design is essentially optimum."

Optimization curves (FIGS. 7 and 8) are presented in the article that show optimum entry angles in the 50–60 milliradian range for the gun design under discussion.

The entry angle, as well as spot size, is dependent upon beam current. The entry angle is about 135 milliradians in the ultra-short electron gun according to the invention when the beam current is 1.5 milliamperes, by way of example. The entry angle is about 35 milliradians at a beam current of 0.2 milliamperes.

Providing an electron gun of ultra-short length according to the invention is not achieved merely by "miniaturizing" a standard bipotential electron gun; that is, by proportionately scaling down such parameters as electrode dimensions and spacings, aperture diameters, and potentials. If such were possible, designing electron guns would be relatively simple. However, such is not the case, as indicated by the general comments of Wilson (ibid) concerning the manifold problems of gun design.

A preferred embodiment of the ultra-short LoBi electron gun according to the invention may have approximately the following dimensions and spacings:

| | Inch |
|---|---|
| G1 aperture diameter | 0.025 |
| G1 thickness, at aperture | 0.007 |
| G1–G2 spacing | 0.008 |
| G2 thickness, at aperture | 0.010 |
| G2 aperture diameter | 0.025 |
| G2–G3 spacing | 0.010 |

-continued

| | Inch |
|---|---|
| G3 aperture diameter | 0.025 |
| G3 length | 0.300 |
| G3 lens diameter | 0.148 |
| G3–G4 spacing | 0.050 |
| G4 lens diameter | 0.148 |

The ultra-short electron gun according to the preferred embodiment of the invention may operate with the following approximate electrical potentials:

| | Volts |
|---|---|
| K potential (at cut off) | 75 |
| G1 potential | 0 |
| G2 potential (with K at cut off) | 310 |
| G3 potential | 1,700 |
| G4 potential | 12,000 |

The parameters of the ultra-short LoBi electron gun according to the invention are also definable by approximate ratios as follows, wherein there is

- a G3 aperture diameter to G3 lens diameter ratio of 0.17;
- a G2 potential to G3 potential ratio of 0.18;
- a G3 potential to G4 potential ratio of 0.14;
- a G3 aperture-diameter to G3 lens diameter ratio of 0.17;
- a G2-G3 field strength to G3-G4 field strength ratio of approximately 0.16;
- a G3 lens diameter to gun-length ratio of 0.3;
- a gun length to throw-distance ratio of 0.23.

The standard bipotential electron gun intended for use in color cathode ray picture tubes normally has a focusing electrode potential of about 6 kV, and an accelerating electrode potential of about 25 kV. The focusing electrode potential is thus about 24 percent of the accelerating electrode potential.

Figure 4:
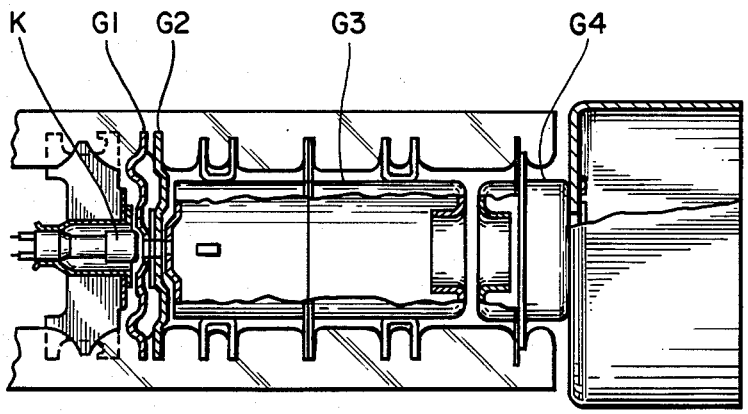
Fig. 4 PRIOR ART
FIG. 4 is a longitudinal elevation, partially in section, of a prior art HiBi electron gun designed for a color television cathode ray picture tube.

A recent trend in electron gun design has been to increase the potential on the focusing electrode to a point where the focusing electrode potential is about twenty-eight percent of the accelerating electrode potential. This design is commonly termed the "HiBi," noted as being an abbreviated acronym for "high focus voltage bipotential (gun)." The voltages are about 8.5 kV on the focusing electrode and about 25 kV on the accelerating electrode. An electron gun of the HiBi type is depicted in FIG. 4. The relatively long focusing electrode (G3) will be noted. Length of the gun is about 1.5 inch, as measured from the surface of the cathode to the end of G4.

Figure 5:
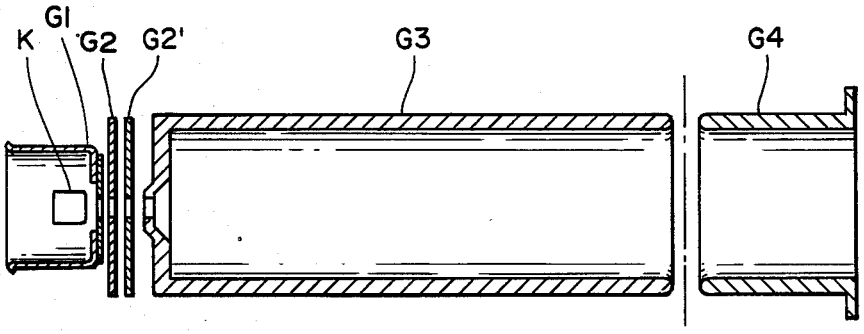
Fig. 5 PRIOR ART
FIG. 5 is a longitudinal elevation in section of a prior art HiBi electron gun designed for a projection television system.

The bipotential gun depicted in FIG. 5 may also be considered a HiBi. This HiBi gun is designed for use in a projection television cathode ray tube. The relatively long focusng electrode (G3) will be noted. The D/L ratio; that is, the lens diameter to electrode length ratio is about 0.25. The length of this gun is about 2.4 inches.

Figure 6:
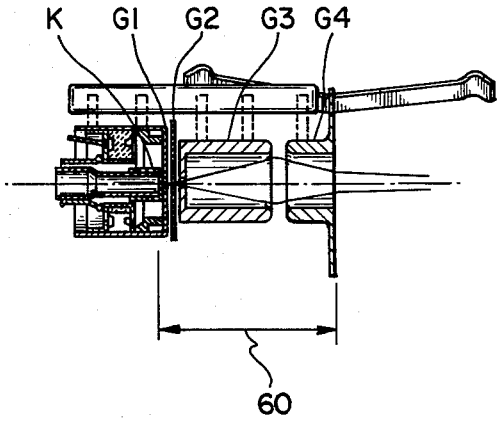
FIG. 6 is a longitudinal elevation of the preferred embodiment of the ultra-short LoBi electron gun according to the invention.

FIG. 6 depicts a novel ultra-short electron gun according to a preferred embodiment of the invention. The ultra-short feature is pointed up by comparison with the two "HiBi" electron guns depicted in FIGS. 4 and 5; it is again noted that all three guns are depicted in a scale of about two times relative to normal size in order that details of the novel ultra-short electron gun shown by FIG. 6 may be discerned in comparison with the guns shown by FIGS. 4 and 5. The focusing electrode G3 of the ultra-short LoBi gun according to the invention will be noted as being relatively short in comparison to the relative lengths of the focusing electrodes G3 of FIGS. 4 and 5. Relative shortness is indicated by the lens diameter to lens length (D/L) ratio of the focusing electrode G3 wherein the gun according to the invention has a D/L ratio of about 0.5.

The focusing electrode (G3) potential of the ultra-short electron gun according to the invention may be about fourteen percent of the potential of the accelerating electrode (G4). The G3 potential may be approximately 1.7 kilovolts, by way of example, and the G4 potential about 12 kilovolts. Thus the inventive design of this novel gun is in contravention to the trend to provide ever-higher focusing electrode potentials characteristic of the HiBi type of bipotential gun 50. The ultra-short electron gun according to the invention is validly termed a "LoBi," an abbreviated acronym for "low focus voltage bipotential (gun)."

The length of the ultra-short LoBi electron gun according to the preferred embodiment of the invention is between 0.45 inch and 0.55 inch, and preferably about 0.5 inch (ref. No. 60). The basis of all gun length measurements is, for the purposes of this disclosure, from the surface of the cathode (K) to the end of the accelerating electrode (G4).

As has been noted, a typical bipotential color television gun normally operates with an entry angle of about 50 milliradians maximum at 1.5 microamps of beam current. In contrast the ultra-short bipotential gun according to the invention requires a half-angle greater than 100 milliradians, at an equivalent beam current.

Also as has been noted, the value of the entry angle is mainly the resultant of the electric field produced by the potentials on the G2 and G3 electrodes, and their geometry and spacing. In general, it can be said that a beam emerges from a physical crossover in a gun lower end just in the G2 aperture and thereafter feels a strong converging force at G2, and a weaker diverging force near G3. As a result, the beam enters the G2-G3 area in most guns initially with a very large divergent angle exceeding in some cases, 500 milliradians. However, the strong convergent forces near G2 reduce the entry angle to a still converging value in the 40–50 milliradian range in standard prior art bipotential electron guns.

The ultra-short electron gun according to the invention, however, reduces the effect of the convergent forces near G2 by the use of the relatively low G3 (focus) potential which is, by way of example, only about fourteen percent of the potential on the accelerating electrode (G4). Typically, color television bipotential guns operate with a G3 potential which is twenty-four percent to thirty-two percent of the accelerating electrode voltage. The low potential on G3 of the preferred embodiment of the gun according to the invention; that is, fourteen percent of the accelerating electrode potential, effectively weakens the convergent forces near G2 and results in a beam exiting the G2-G3 area with a divergent entry angle greater than 100 milliradians, and preferably one that exceeds 126 milliradians.

It is essential in electron gun design, whether the gun be a bipotential or other, that the beam entry angle and apparent source position be of the proper value so that the beam will optimally fill the main focus lens. If this optimum filling is accomplished, the total effect from spherical aberration, object magnification and space charge repulsion will be minimized, and a beam spot of minimum diameter will be focused on the phosphor screen.

The ultra-short bipotential gun according to the invention operates most effectively when its entry angle slightly exceeds 126 milliradians, and preferably is about 135 milliradians. The result is minimum spot size and consequent high resolution.

The objective of an ultra-short gun was achieved in the gun according to the invention; that is, a length of about 0.5 inch or less—a notable reduction in length by a factor of about two. The application of the ultra-short LoBi electron gun according to the invention, and the inventive principles which made it possible, is not limited to very short cathode ray tubes for vehicles. It is anticipated that the ultra-short LoBi gun according to the principles of the invention can be used in relatively larger television cathode ray tubes, both monochrome and color. In a color gun configuration, three of the guns according to the invention would be used, with the electrodes unitized form, for example, and the guns arranged in-line or in delta-configuration. By using the ultra-short electron gun according to the invention, the relatively long neck of the standard television cathode ray tube could be shortened substantially, and the depth of the cabinet could be reduced correspondingly.

While particular embodiments of the invention have been shown and described, it will be apparent to those skilled in the art that changes and modifications may be made without departing from the invention in its broader aspects, and therefore, the aid of the appended claims is to cover all such changes and modifications as fall within the true spirit and scope of the invention. The matter set forth in the foregoing description and accompanying drawings is offered by way of example only and is not intended as a limitation. The actual scope of the invention is intended to be defined in the following claims when viewed in their proper perspective based on the prior art.

I claim:

1. For use in a very short, high-brightness vehicular cathode ray tube having an associated power supply for developing a predetermined pattern of supply voltages, an ultra-short high-performance electron gun having a series of electrodes aligned on an axis for receiving said voltages to produce a finely focused beam of electrons focused on said screen, said gun comprising:

lower end means having a cathode for developing an electron beam, said lower end means further including:

at least one apertured plate grid electrode for forming, in conjunction with said cathode, said beam;

at least one apertured plate prefocusing electrode for receiving a relatively low prefocusing voltage from said power supply for developing, in conjunction with said grid electrode, a crossover in said beam;

main focus lens means for receiving, focusing and accelerating said beam including:

cylindirical focusing electrode means for receiving a relatively intermediate beam focusing voltage approximating 1700 volts from said power supply for focusing a beam spot of minimum size on said screen, the spacing between said focusing electrode and said prefocusing electrode, and the relative difference in potential therebetween, being effective to develop a weak electrostatic field for forming a steeply expanding beam having an entry angle greater than one hundred milliradians;

cylindrical accelerating electrode means for receiving a relatively high beam accelerating voltage from said power supply for accelerating said electron beam, the ratio of the potentials of said voltage on said accelerating electrode means and the potential on said focusing electrode means being greater than six to one for forming a relatively strong electrostatic field therebetween;

said gun electrodes having approximately the following dimensions and spacings:

| | Inch |
|---|---|
| G1 aperture diameter | 0.025 |
| G1 thickness, at aperture | 0.007 |
| G1–G2 spacing | 0.008 |
| G2 thickness, at aperture | 0.010 |
| G2 aperture diameter | 0.025 |
| G2–G3 spacing | 0.010 |
| G3 aperture diameter | 0.025 |
| G3 length | 0.300 |
| G3 lens diameter | 0.148 |
| G3–G4 spacing | 0.050 |
| G4 lens diameter | 0.148 |

such that said weak electrostatic field between said prefocusing electrode and said focusing electrode is effective to produce said steeply expanding beam for optimally filling said main focus lens means, and said relatively strong electrostatic field between said focusing electrode means and said accelerating electrode means is effective to produce a finely focused electron beam notwithstanding the ultra-short length of said gun.

* * * * *